United States Patent [19]

Bakewell

[11] Patent Number: 4,810,852

[45] Date of Patent: Mar. 7, 1989

[54] HIGH-RESOLUTION THERMAL PRINTHEAD AND METHOD OF FABRICATION

[75] Inventor: Joseph J. Bakewell, Boxford, Mass.

[73] Assignee: Dynamics Research Corporation, Wilmington, Mass.

[21] Appl. No.: 176,638

[22] Filed: Apr. 1, 1988

[51] Int. Cl.[4] ..... B41J 3/20

[52] U.S. Cl. ..... 219/216; 346/76 PH

[58] Field of Search ..... 219/216 PH, 543; 346/76 PH; 400/120; 29/611

[56] References Cited

U.S. PATENT DOCUMENTS

| | | | |
|---|---|---|---|
| 3,931,492 | 1/1976 | Takano et al. | 219/216 |
| 3,973,106 | 8/1976 | Ura | 219/216 |
| 3,998,980 | 12/1976 | Antes et al. | 427/103 |
| 4,007,352 | 2/1976 | Ura | 219/216 |
| 4,153,518 | 5/1979 | Holmes et al. | 204/38 |
| 4,169,032 | 9/1979 | Hasse et al. | 204/192 |
| 4,206,541 | 6/1980 | Marciniec | 29/611 |
| 4,259,676 | 3/1981 | Salmon et al. | 346/76 |
| 4,298,786 | 11/1981 | Marciniec | 219/216 |
| 4,334,231 | 6/1982 | Regehr | 346/35 |
| 4,394,092 | 7/1983 | Osmera et al. | 400/120 |
| 4,399,348 | 8/1983 | Bakewell | 219/216 |
| 4,423,424 | 12/1983 | Takayama | 346/76 |
| 4,423,425 | 12/1983 | Reese et al. | 346/76 |
| 4,456,915 | 6/1984 | Crooks | 219/216 |
| 4,517,444 | 5/1985 | Kawahito et al. | 219/216 |
| 4,534,814 | 8/1985 | Volpe | 219/543 |
| 4,571,826 | 2/1986 | Jacobs | 29/840 |
| 4,574,292 | 3/1986 | Takikawa et al. | 346/76 |
| 4,595,823 | 6/1986 | Sorimachi et al. | 219/216 |
| 4,636,811 | 1/1987 | Bakewell | 346/76 |
| 4,636,812 | 1/1987 | Bakewell | 246/76 |

*Primary Examiner*—Teresa J. Walberg

*Attorney, Agent, or Firm*—Weingarten, Schurgin, Gagnebin & Hayes

[57] ABSTRACT

A high-resolution thermal printhead and method of fabrication is provided. The printhead is of laminated construction in which densely packed circuitry required to achieve high resolution print is separated from other circuitry not requiring such dense packing. Therefore, the expensive fabrication processes required to produce the fine, high-resolution circuitry are limited to such circuitry, while less expensive fabrication processes are used to manufacture all other portions of the printhead.

22 Claims, 3 Drawing Sheets

HIGH-RESOLUTION THERMAL PRINTHEAD AND METHOD OF FABRICATION

FIELD OF THE INVENTION

This invention relates to thermal printing and, more particularly, to a high-resolution thermal printhead and method of fabricating such a printhead.

BACKGROUND OF THE INVENTION

Dot matrix printing using thermal printheads is well known. Alphanumeric or other characters are formed by selectively heating small portions of thermally sensitive paper as the paper moves across the printhead surface. Resistors deposited in one or more rows along the length of the printing edge of the printheads are heated when power is applied. This heat marks thermally sensitive paper drawn across the printhead surface.

The resolution of thermal printing is generally limited by the density of the resistors on the printhead surface, which in turn is limited by the density of the electrodes and conductive paths leading to the resistors. As a general rule, electrodes, and therefore resistors, must be spaced equal to their width. Multiple-row spacing of resistive elements has increased the limit of print resolution; however, resolutions as great as 300 dots/inch have been difficult to produce economically. In general, very high resolution printheads are complex and expensive to construct.

SUMMARY OF THE INVENTION

A high-resolution thermal printhead and economical method of fabrication is provided. The thermal printhead is comprised of a laminated structure having identical stacked halves separated by a metal spacer sheet which also acts as a heat sink. Each half is comprised of a thin glass circuit board upon which is deposited a metal ground electrode plane on one surface and an array of closely spaced electrodes and conductors on the opposite surface. Each half is also comprised of a dielectric-coated copper/invar/copper (CIC) sheet upon which printhead driver chips, input-output pads, conductive paths and other coarse circuitry are disposed. A ceramic separator or a coating of dielectric material separates the closely spaced circuitry of the glass circuit board from the CIC circuit board Windows in the CIC board and in the ceramic separator or dielectric coating allow connection of the driver chips and other coarse circuitry of the CIC board to the closely spaced circuitry of the glass board. Resistors disposed over the printing edge of the glass board connect the closely spaced electrodes with the ground electrode plane. The resistors complete the electrical circuit and provide the means for marking thermal paper confronting the printing edge of the thermal printhead.

An advantage of the invention is that the glass board can be separately fabricated using high-precision techniques. The most critical area of the glass circuit board is the head area. To achieve 300 dot/inch resolution, the electrode discrimination at the head must be very fine. Therefore, high-precision techniques are necessary to produce such highly densed electrodes and their associated conductors. By separating the circuitry that must be precisely fabricated (the electrodes and their associated conductors) from all of the other circuitry of the printhead, the components most sensitive to precision manufacture can be separately fabricated and tested.

Expensive, precision techniques therefore are limited to only the components which must be fabricated by such techniques. In general, each layer of the laminated structure and therefore each component of the printhead can be fabricated separately by the techniques and precision levels most economically suited for the respective layer. Less expensive methods can be used to fabricate less critical layers, and expensive techniques need be used only for the layer or layers where such techniques are necessary. Because each layer is separately manufactured and tested, failures in the discrete components of particular layers do not necessitate expensive scrapping of other satisfactory parts of the head.

Another advantage of the invention is that it affords better thermal control of the printhead. Heat generated by the driver chips should not affect the resistors. Because the driver chips of the invention are mounted on the outside surfaces of the CIC boards, they are isolated from the resistors by the CIC boards and, in one embodiment, the ceramic separators. Therefore, the heat generated by the driver chips dissipates into the CIC boards and the separators and cannot affect the heat output of the resistors. All of the heat at the printhead writing surface therefore is generated by the resistors alone, which heat dissipates into the thermal paper moving across the printhead writing surface, into heat sinks mounted at the printhead writing surface and into the metal spacer sheet (which also acts as a heat sink).

DESCRIPTION OF THE DRAWINGS

The present invention will be more fully understood by referring to the following detailed description in conjunction with the accompanying drawings, of which.

DETAILED DESCRIPTION OF THE INVENTION

Figure 1:
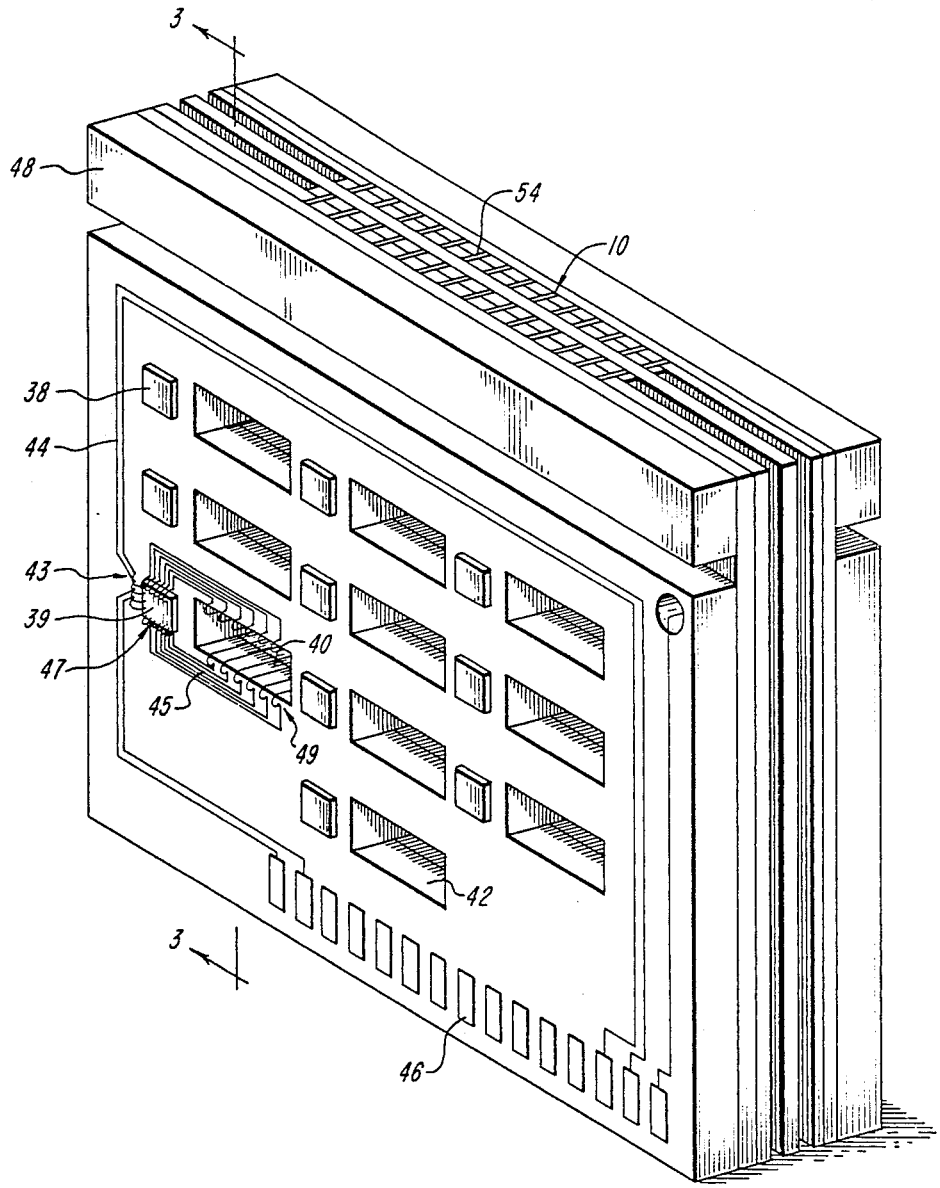
FIG. 1 is a perspective view of a thermal printhead constructed in accordance with the invention.
Figure 2:
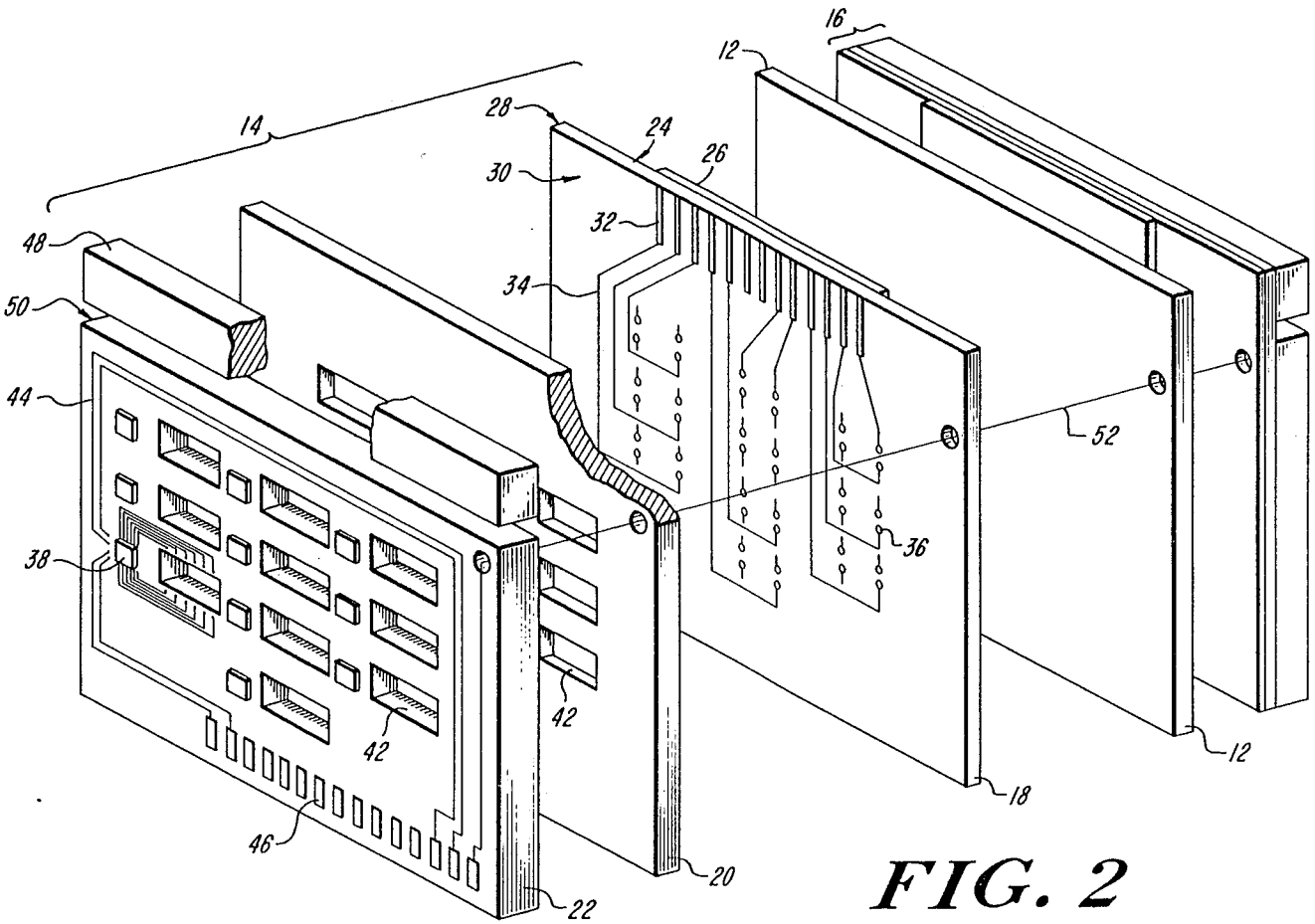
FIG. 2 is an exploded perspective view of a thermal printhead constructed in accordance with the invention, but without wire bonds and resistors.
Figure 3:
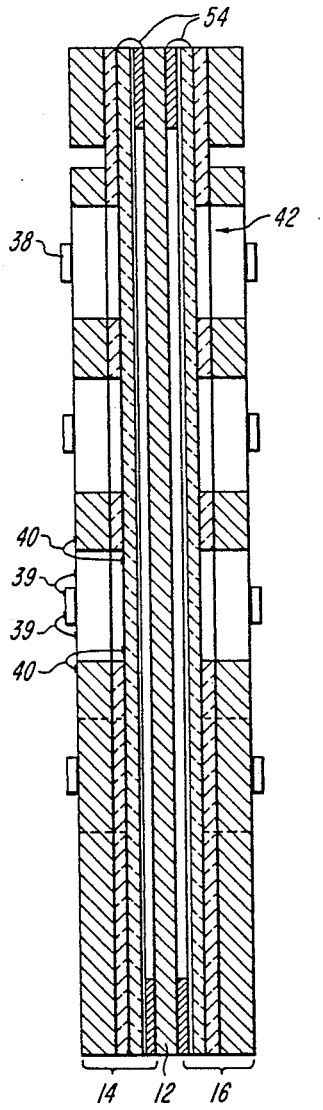
FIG. 3 is a cross-sectional view taken along plane 3—3 of FIG. 1.

Referring to FIG. 1, there is shown a laminated thermal printhead fabricated in accordance with the present invention and having a printhead writing surface 10. From the drawings, it can be seen that a 10 mil metal spacer sheet 12 which provides support and acts as a heat sink is sandwiched between identical halves 14 and 16 of the printhead. Each half contains a glass circuit board 18, a ceramic separator 20, and a dielectric-coated copper/invar/copper (CIC) circuit board 22.

The glass circuit board 18 is composed of a 2 mil glass sheet vacuum coated with successive layers of chromium, inconel and copper. On one surface 24 and confronting the metal spacer sheet 12 is deposited a metal ground electrode plane 26 which abuts the printhead surface edge 28 of the glass circuit board. On the opposite surface 30 is precisely deposited a fine array of printhead electrodes 32 which also abut the printhead surface edge 28. Conductors 34 and connector pads 36 are deposited upon the same opposite surface 30 and lead to the printhead electrodes 32.

The ceramic separator 20 is preferably made of alumina, but can also be made of any other ceramic material having dielectric properties similar to alumina. In an alternative embodiment (not shown), the separator can comprise a dielectric coating applied directly over the electrodes and conductive paths of the glass circuit board.

On the CIC board 22, which is clad with a coating of ceramic material, are mounted driver chips 38 which are connected to the connector pads 36 of the glass circuit board 18 by wire bonds through windows 42 in the CIC board and the ceramic separator. Conductive paths 44 extend from the input-output pads 46 on the CIC board 22 to pads 43 confronting the driver chip 38. Paths 45 extend from pads 47 adjacent the driver chips to pads 49 adjacent the windows 42. The chips are wire bonded via bonds 39 to the appropriate pads 43 and 47, and pads 49 are wire bonded via bonds 40 through the windows 42 to the proper pads 36 of board 18. The particular interconnection path configuration can be varied to suit the intended layout. A heat sink 48 of a desired thickness is mounted at the printhead surface edge 50 of the CIC board.

An access hole 52 through the CIC board 22, ceramic separator 20, glass circuit board 18 and metal spacer sheet 12 permits connection of the metal ground electrode plane 26 to the input-output pads 46.

Figure 4:
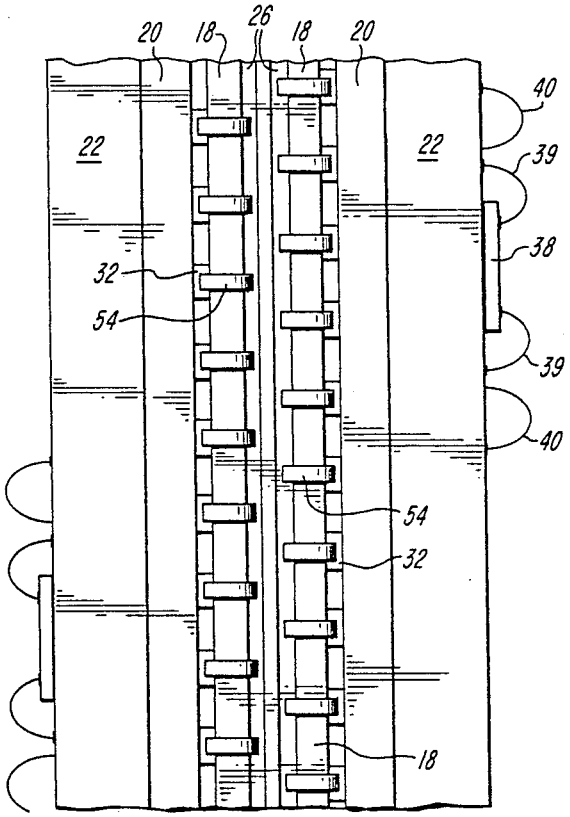
FIG. 4 is a top view of a thermal printhead constructed in accordance with the invention.

As best can be seen in FIG. 4, across the printhead surface edge of each glass circuit board are disposed resistors 54 which connect the electrodes 32 on one surface of the glass board with the ground plane 26 on the opposite surface. The resistors are the thermal elements which, when activated, mark thermal sensitive paper passing over the printhead. As an alternative to the embodiment shown in FIG. 4, a layer of resistive material, rather than individual resistors, can be disposed across the printhead surface edge.

Fabrication of the laminated printhead is accomplished by first laminating a 2 mil thin glass sheet to a 60 mil glass carrier. The surfaces are first cleaned, wax is applied to the carrier, and then the 2 mil thin glass sheet is laminated to the carrier by a vacuum/heat or hot roll process. Such processes are well known to one skilled in the art.

After lamination to the carrier, the thin glass sheet is cleaned and vacuum coated, using conventional well-known techniques, with the successive layers of chromium, inconel and copper. The coated thin glass sheet is then masked for deposition of the ground electrode plane and several layers of nickel and gold are plated to form a ground electrode plane approximately 3 mil thick. Using conventional techniques, the mask is stripped and the background is etched away. The thin glass is then transferred to a second 60 mil glass carrier, using the process discussed above, and the first carrier is removed exposing the opposite surface of the thin glass for deposition of the electrodes and other fine circuitry.

The exposed opposite surface of the thin glass is first cleaned and vacuum-coated, as above, with successive layers of chromium, inconel and copper. Photoresist is applied over the exposed surface to form the electrode and conductive path patterns, and the photoresist is exposed, developed and light-baked in a manner well-known in the art. Thereafter, several layers of nickel and gold are deposited on the exposed thin glass board. Gold is also heavily plated near the printhead surface edge of the glass board to form the electrodes. The photoresist is then stripped away and the background is etched. The resulting electrode and conductor pattern is checked for shorts, opens and proper resistances, and repaired as necessary.

As a separate operation, a 10 mil ceramic-clad sheet of the CIC is cut to size and access windows are cut at desired locations. The front surface of the sheet, which corresponds to the outside surface of the printhead, is patterned with input-output pads, driver chip pads, and conductive pathways by an inexpensive and well-known silkscreen process. In an alternative embodiment (not shown), the input-output paths, driver chip pads, and connector pathways may also be fabricated on two sides of a thin Kapton sheet, which is then laminated to the CIC sheet by a conventional, well-known process.

Also, as separate operations, a 10 mil metal spacer sheet and a ceramic separator sheet are cut to size. Access windows are also cut into the ceramic separator sheet at desired locations. The ceramic separator sheet is then sandwiched between the electrode and conductor surface of the thin glass board and the back surface of the CIC board. In an alternative embodiment, a layer of dielectric coating is applied, in a manner well known to one skilled in the art, over the electrode and conductor surface of the thin glass board after the electrodes and conductors are deposited, tested and repaired as necessary. This coating, however, is not applied over the connector pads on the thin glass board.

The resulting half is matched and registered to a similarly fabricated second half such that the metal spacer sheet is sandwiched between the ground electrode plane surfaces of the thin glass boards. Registration holes are drilled so that the laminated layers will be held in phase registration to the other. The layers are then laminated together by conventional, well-known techniques, and the heat sinks are attached at the printhead surface edge of the CIC boards.

To form the printhead writing surface, the structure is cut through the top edge and the resulting end surface is ground to shape and polished to form a surface that will be coplanar with the thermal paper path. Onto the printhead writing surface individual resistors are deposited to connect the printhead electrodes to the ground electrode planes. As mentioned above, a layer of resistive material rather than individual resistors can be deposited onto the printhead writing surface. The resistors are deposited by sputter deposit, etching, photoresist or other well-known techniques. The resistors are then stabilized and a wear-coat layer is applied through sputter deposition. Resistance values are checked and, if necessary, the printhead writing surface is repolished and resistors are reapplied. After satisfactory deposition of resistors onto the printhead writing surface, driver chips are mounted on the front surfaces of the CIC boards and wire-bonded to the connector pads of the thin glass boards through the windows cut into the CIC boards and the ceramic separator sheets. The complete printhead is then functionally checked, and if it is satisfactory, the driver chips are sealed.

Having indicated a preferred embodiment of the present invention, it will occur to those skilled in the art that modifications and alternatives can be practised in the spirit of the invention. It is therefore intended that the scope of the invention be defined only by the following claims.

What is claimed is:

1. A thermal printhead comprising:

a first sheet of dielectric material having first and second opposing surfaces and an edge;

a plurality of electrodes regularly spaced along said edge of the first sheet;

a plurality of connector pads disposed on the first surface of the first sheet;

a plurality of conductors disposed on the first surface of the first sheet and providing electrical paths between the electrodes and the connector pads;

a ground electrode plane disposed on the second surface of the first sheet, terminating at said edge of the first sheet and extending along at least part of the length of the edge;

a second sheet of dielectric material having first and second opposing surfaces and at least one opening;

circuitry disposed on the first surface of the second sheet;

a third sheet of dielectric material having at least one opening;

the first, second and third sheets being disposed in laminated engagement, with the third sheet sandwiched between the first surface of the first sheet and the second surface of the second sheet, and with the openings of the second and third sheets in communication with the connector pads of the first surface of the first sheet;

means for connecting the circuitry on the first surface of the second sheet to the connector pads on the first surface of the first sheet through the openings of the second and third sheets;

resistive material connecting the electrodes to the ground electrode plane over said edge of the first sheet.

2. The invention of claim 1, wherein the third sheet of dielectric material is a coating of dielectric material.

3. The invention of claim 1, wherein the means for connecting the circuitry on the first surface of the second sheet to the connector pads on the first surface of the first sheet is a plurality of wire bonds.

4. The invention of claim 1, wherein the spacer sheet is made of metal.

5. The invention of claim 1, wherein the resistive material is comprised of a plurality of resistors severally connecting the electrodes to the ground electrode plane.

6. The invention of claim 1, wherein the resistive material is in the form of a layer disposed along said edge of the first sheet.

7. The invention of claim 1, wherein the first sheet is made of glass.

8. The invention of claim 1, wherein the second sheet is made of ceramic-coated copper/invar/copper.

9. The invention of claim 1, wherein the third sheet is made of alumina.

10. A thermal printhead comprising:

first and second printhead halves separated and joined by a spacer sheet, each half including:

a first sheet of dielectric material having first and second opposing surfaces and an edge;

a plurality of electrodes regularly spaced along said edge of the first sheet;

a plurality of connector pads disposed on the first surface of the first sheet;

a plurality of conductors disposed on the first surface of the first sheet and providing electrical paths between the electrodes and the connector pads;

a ground electrode plane disposed on the second surface of the first sheet, terminating at said edge of the first sheet and extending along at least part of the length of the edge;

a second sheet of dielectric material having first and second opposing surfaces and at least one opening;

circuitry disposed on the first surface of the second sheet;

a third sheet of dielectric material having at least one opening;

the first, second and third sheets being disposed in laminated engagement, with the third sheet sandwiched between the first surface of the first sheet and the second surface of the second sheet, and with the openings of the second and third sheets in communication with the connector pads of the first surface of the first sheet;

means for connecting the circuitry on the first surface of the second sheet to the connector pads on the first surface of the first sheet through the openings of the second and third sheets;

resistive material connecting the electrodes to the ground electrode plane over said edge of the first sheet.

11. The invention of claim 10, wherein the third sheet of dielectric material is a coating of dielectric material.

12. The invention of claim 10, wherein the means for connecting the circuitry on the first surface of the second sheet to the connector pads on the first surface of the first sheet is a plurality of wire bonds.

13. The invention of claim 10, wherein the spacer sheet is made of metal.

14. The invention of claim 10, wherein the resistive material is comprised of a plurality of resistors severally connecting the electrodes to the ground electrode plane.

15. The invention of claim 10, wherein the resistive material is in the form of a layer disposed along said edge of the first sheet.

16. The invention of claim 10, wherein the first sheet is made of glass.

17. The invention of claim 10, wherein the second sheet is made of ceramic-coated copper/invar/copper.

18. The invention of claim 10, wherein the third sheet is made of alumina.

19. A method for fabricating a thermal printhead, comprising the steps of:

laminating a first dielectric sheet to a carrier such that one side of the sheet is exposed;

depositing a ground electrode plane onto the exposed surface of the first dielectric sheet such that the ground electrode plane abuts an edge of the sheet and extends along the length of the edge;

laminating the exposed surface of the first dielectric sheet to a second carrier;

removing the first carrier such that a second opposite surface of the first dielectric sheet is exposed;

depositing an array of electrodes, conductors and connector pads onto the second exposed surface such that the electrodes abut said edge of the sheet and are spaced along the length of the edge;

cutting openings in second and third dielectric sheets such that the openings correspond to the locations of the connector pads on the second exposed surface of the first dielectric sheet;

disposing circuitry onto a first surface of the second dielectric sheet;

laminating a second opposite surface of the second dielectric sheet to a first surface of the third dielectric sheet such that the openings of the second and third sheets communicate with each other and correspond to the locations of the connector pads on the second exposed surface of the first dielectric sheet;

laminating a second opposite surface of the third dielectric sheet to the second exposed surface of the first dielectric sheet to form a structure such that the openings of the third dielectric sheet communicate with the connector pads of the first dielectric sheet;

cutting through the structure at said edge of said first dielectric sheet to form a printhead writing surface;

depositing resistive material on the printhead writing surface to connect said electrodes to said ground electrode plane; and connecting the circuitry of the second dielectric sheet to the connector pads of the first dielectric sheet through the openings in the second and third dielectric sheets.

20. A method for fabricating a thermal printhead, comprising the steps of:

laminating a first dielectric sheet to a carrier such that one side of the sheet is exposed;

depositing a ground electrode plane onto the exposed surface of the first dielectric sheet such that the ground electrode plane abuts an edge of the sheet and extends along the length of the edge;

laminating the exposed surface of the first dielectric sheet to a second carrier;

removing the first carrier such that a second opposite surface of the first dielectric sheet is exposed;

depositing an array of electrodes, conductors and connector pads onto the second exposed surface such that the electrodes abut said edge of the sheet and are spaced along the length of the edge;

coating the electrodes and conductors deposited on the second exposed surface of the first dielectric sheet with a dielectric material;

cutting openings in a second dielectric sheet such that the openings correspond to the location of the connector pads on the second exposed surface of the first dielectric sheet;

disposing circuitry onto a first surface of the second dielectric sheet;

laminating a second opposite surface of the second dielectric sheet to the second exposed surface of the first dielectric sheet to form a structure such that the openings of the second dielectric sheet communicate with the connector pads of the first dielectric sheet;

cutting through the structure at said edge of said first dielectric sheet to form a printhead writing surface;

depositing resistive material on the printhead writing surface to connect said electrodes to said ground electrode plane; and connecting the circuitry of the second dielectric sheets to the connector pads of the first dielectric sheet through the openings in the second dielectric sheets.

21. A method for fabricating a thermal printhead, comprising the steps of:

laminating a first dielectric sheet to a carrier such that one side of the sheet is exposed;

depositing a ground electrode plane onto the exposed surface of the first dielectric sheet such that the ground electrode plane abuts an edge of the sheet and extends along the length of the edge;

laminating the exposed surface of the first dielectric sheet to a second carrier;

removing the first carrier such that a second opposite surface of the first dielectric sheet is exposed;

depositing an array of electrodes, conductors and connector pads onto the second exposed surface such that the electrodes abut said edge of the board and are spaced along the length of the edge;

cutting openings in second and third dielectric sheets such that the openings correspond to the locations of the connector pads on the second exposed surface of the first dielectric sheet;

disposing circuitry onto a first surface of the second dielectric sheet;

laminating a second opposite surface of the second dielectric sheet to a first surface of the third dielectric sheet such that the openings of the second and third sheets communicate with each other and correspond to the locations of the connector pads on the second exposed surface of the first dielectric sheet;

laminating a second opposite surface of the third dielectric sheet to the second exposed surface of the first dielectric sheet to form a first printhead half such that the openings of the third dielectric sheet communicate with the connector pads of the first dielectric sheet;

preparing a second printhead half in the same manner used to prepare the first printhead half;

laminating the first and second printhead halves to opposite sides of a spacer sheet to form a laminate structure such that the spacer sheet confronts the ground electrode planes of the first and second printhead halves;

cutting through the laminated structure at said edges of said first dielectric sheets to form a printhead writing surface;

depositing resistive material on the printhead writing surface to connect the electrodes of each printhead half to the ground electrode plane of the printhead half; and for each printhead half, connecting the circuitry of the second dielectric sheets to the connector pads of the first dielectric sheets through the openings in the second dielectric sheets.

22. A method for fabricating a thermal printhead, comprising the steps of:

laminating a first dielectric sheet to a carrier such that one side of the sheet is exposed;

depositing a ground electrode plane onto the exposed surface of the first dielectric sheet such that the ground electrode plane abuts an edge of the sheet and extends along the length of the edge;

laminating the exposed surface of the first dielectric sheet to a second carrier;

removing the first carrier such that a second opposite surface of the first dielectric sheet is exposed;

depositing an array of electrodes, conductors and connector pads onto the second exposed surface such that the electrodes abut said edge of the sheet and are spaced along the length of the edge;

coating the electrodes and conductors deposited on the second exposed surface of the first dielectric sheet with a dielectric material;

cutting openings in a second dielectric sheet such that the openings correspond to the location of the connector pads on the second exposed surface of the first dielectric sheet;

disposing circuitry onto a first surface of the second dielectric sheet;

laminating a second opposite surface of the second dielectric sheet to the second exposed surface of the first dielectric sheet to form a first printhead half such that the openings of the second dielectric sheet communicate with the connector pads of the first dielectric sheet;

preparing a second printhead half in the same manner used to prepare the first printhead half;

laminating the first and second printhead halves to opposite sides of a spacer sheet to form a laminate structure such that the spacer sheet confronts the ground electrode planes of the first and second printhead halves;

cutting through the laminated structure at said edges of said first dielectric sheets to form a printhead writing surface;

depositing resistive material on the printhead writing surface to connect the electrodes of each printhead half to the ground electrode plane of the printhead half; and for each printhead half, connecting the circuitry of the second dielectric sheets to the connector pads of the first dielectric sheets through the openings in the second dielectric sheets.

* * * * *